US005218853A

United States Patent [19]

Mueller et al.

[11] Patent Number: 5,218,853

[45] Date of Patent: Jun. 15, 1993

[54] SINGLE-CYCLE CLOSED DIE METAL FORGING METHOD

[75] Inventors: William A. Mueller, Fairhaven; Ranny J. Nunley, Berkley, both of Mich.

[73] Assignee: General Motors Corporation, Detroit, Mich.

[21] Appl. No.: 868,896

[22] Filed: Apr. 16, 1992

[51] Int. Cl.[5] ..... B21J 05/02

[52] U.S. Cl. ..... 72/325; 72/355.6; 72/357

[58] Field of Search ..... 72/325, 327, 328, 334, 72/354.6, 354.8, 355.2, 355.4, 355.6, 407

[56] References Cited

U.S. PATENT DOCUMENTS

| | | | |
|---|---|---|---|
| 866,021 | 9/1907 | Hansen . | |
| 1,007,941 | 11/1911 | Hansen . | |
| 1,007,943 | 11/1911 | Hansen . | |
| 1,007,945 | 11/1911 | Hansen . | |
| 1,087,583 | 2/1914 | Hansen . | |
| 3,169,256 | 2/1965 | Siebol et al. | 72/355.4 |
| 4,245,491 | 1/1981 | Kondo et al. | 72/254 |
| 4,299,112 | 11/1981 | Kondo et al. | 72/334 |
| 4,463,590 | 8/1984 | Theobald | 72/354 |
| 4,543,812 | 10/1985 | Theobald | 72/354 |
| 4,796,459 | 1/1989 | Mueller et al. | 72/354 |

FOREIGN PATENT DOCUMENTS

| | | | |
|---|---|---|---|
| 84847 | 4/1987 | Japan | 72/354.8 |

*Primary Examiner*—Lowell A. Larson
*Attorney, Agent, or Firm*—Patrick M. Griffin

[57] ABSTRACT

An apertured part is pressed in a single cycle with no separate slug shearing operation. The press ram and bolster each contain fixed aperture forming punches which extend coaxially and slidably through piston like die supports, each of which is backed by a hydraulic fluid chamber. Separate systems control the fluid pressure in the two chambers so as to cause the dies supports to slide in one direction relative to the punches initially, then quickly in the other direction to shear the slug formed between the ends of the punches away from the part. The ram chamber is maintained at a high pressure throughout the first half of the stroke, while the bolster chamber begins at a low pressure and is allowed to rise to a higher, intermediate pressure that is still lower than the bolster chamber. Thus, the ram die support pushes the bolster die support down. However, when the pressure differential is removed, the two die supports quickly move up together over the fixed punches, shearing the slug out of the part.

2 Claims, 3 Drawing Sheets

SINGLE-CYCLE CLOSED DIE METAL FORGING METHOD

This invention relates to closed die metal forging in general, and specifically to a method of forging an apertured part in one cycle, without a separate piercing step.

BACKGROUND OF THE INVENTION

Closed die metal forging, sometimes referred to as impact machining, has been used for some time as an alternative to more expensive machining techniques. A known apparatus and method are described in detail in U.S. Pat. No. 4,796,459 to Mueller et al, which is assigned to the assignee of the subject invention. Through the use of dies that are forced together under great pressure, quite complex parts, such as toothed gears, can be forged without grinding or machining the teeth. A pair of die supports carry mating cavities that match the desired part shape. When closed together, a metal blank is pressed out, closely filling the mated cavities to create the part. In order to accommodate the extremely high pressures involved, the forging apparatus disclosed in the patent backs the die supports with hydraulic oil chambers formed in a movable upper ram and a fixed lower bolster. A special fluid accumulator and pressure intensifier system is used to control and tailor the fluid pressure in the chambers throughout the forming process. As the die supports initially close, the pressure in the chambers is kept lower to cushion the impact and reduce noise. As the blank begins to be pressed into shape, and the die separation forces consequently rise, the pressure in the chambers is allowed to rise so as to prevent die separation.

When the part formed has a central aperture, such as a pinion gear for a vehicle differential, a pair of coaxial punches is used to partially form the aperture. Each punch is rigidly fixed to a respective ram and bolster, and each die support slides over a punch as it is compressed back into its respective chamber, like a piston. Each die support moves back substantially the same distance as the other, since the pressure backing them is kept substantially constant. In fact, it is the rigid punches that actually apply the force that extrudes the blank out into the mated cavities. A shortcoming of this system is that the punches cannot form a complete aperture. The ends of the punches come close together under great force, but, inevitably, there is a slug of metal left between them. After the part is removed, the slug is punched out in a separate, subsequent step. It would save considerable time and cost if the slug did not have to be removed separately.

SUMMARY OF THE INVENTION

The invention provides a novel method of using the type of apparatus described, which forms the entire part in one cycle.

In the method of the invention, instead of maintaining the pressure behind the die supports equal with a single accumulator and intensifier system, separate, dedicated systems are used to control the pressure behind each die support individually. At the beginning of the cycle, when the die supports first meet, the pressure in the ram chamber is kept very high, while that in bolster chamber is kept low. Therefore, as the ram and bolster move together, the die supports do not move back within their respective chambers equally. Instead, the upper die support moves one-to-one with the ram and upper punch, pushing the lower die support down, which slides down over its punch as fluid is forced out of the lower chamber. As this occurs, the pressure in the upper chamber is maintained, while the expelled fluid from the lower chamber is accumulated and intensified to a higher, intermediate pressure. The intermediate pressure is kept deliberately lower than the upper chamber pressure, however, so that the unequal die support motion is maintained.

At the end of the down stroke, called bottom dead center, the part is fully formed, but for the slug left between the ends of the punches. Next, the fluid in the ram chamber is quickly exhausted, while the accumulated fluid from the bolster chamber is allowed to rush back in. Now, the pressure differential is allowed to equalize, and the lower die support pushes the upper one up as they slide up together over the coaxial punches. As this occurs, the blank is sheared out of the aperture. Finally, the die supports can be parted, and the part and sheared slug removed.

It is, therefore, a general object of the invention to close die forge an apertured part in one press cycle, with no subsequent slug removal operation.

It is another object of the invention to provide a new way of using a known closed die forging apparatus to achieve one-cycle operation.

It is another object of the invention to use the known apparatus with separate, dedicated fluid pressure control systems to create a differential sliding action between the fixed punches and the sliding die supports that will shear off the slug at the end of the press cycle.

It is still another object of the invention to use the dedicated pressure control systems to initially maintain the ram chamber pressure very high and the bolster chamber pressure very low, thereby forcing the bolster die support down with the ram die support while accumulating the fluid expelled from the bolster chamber at a higher intermediate pressure, then exhausting the pressure from the ram chamber and allowing the accumulated fluid to re-enter the bolster chamber, thereby forcing both die supports to slide up together over the punches and shear out the slug.

DESCRIPTION OF THE PREFERRED EMBODIMENT

These and other objects and features of the invention will appear from the following written description, and from the drawings, in which.

Figure 1:
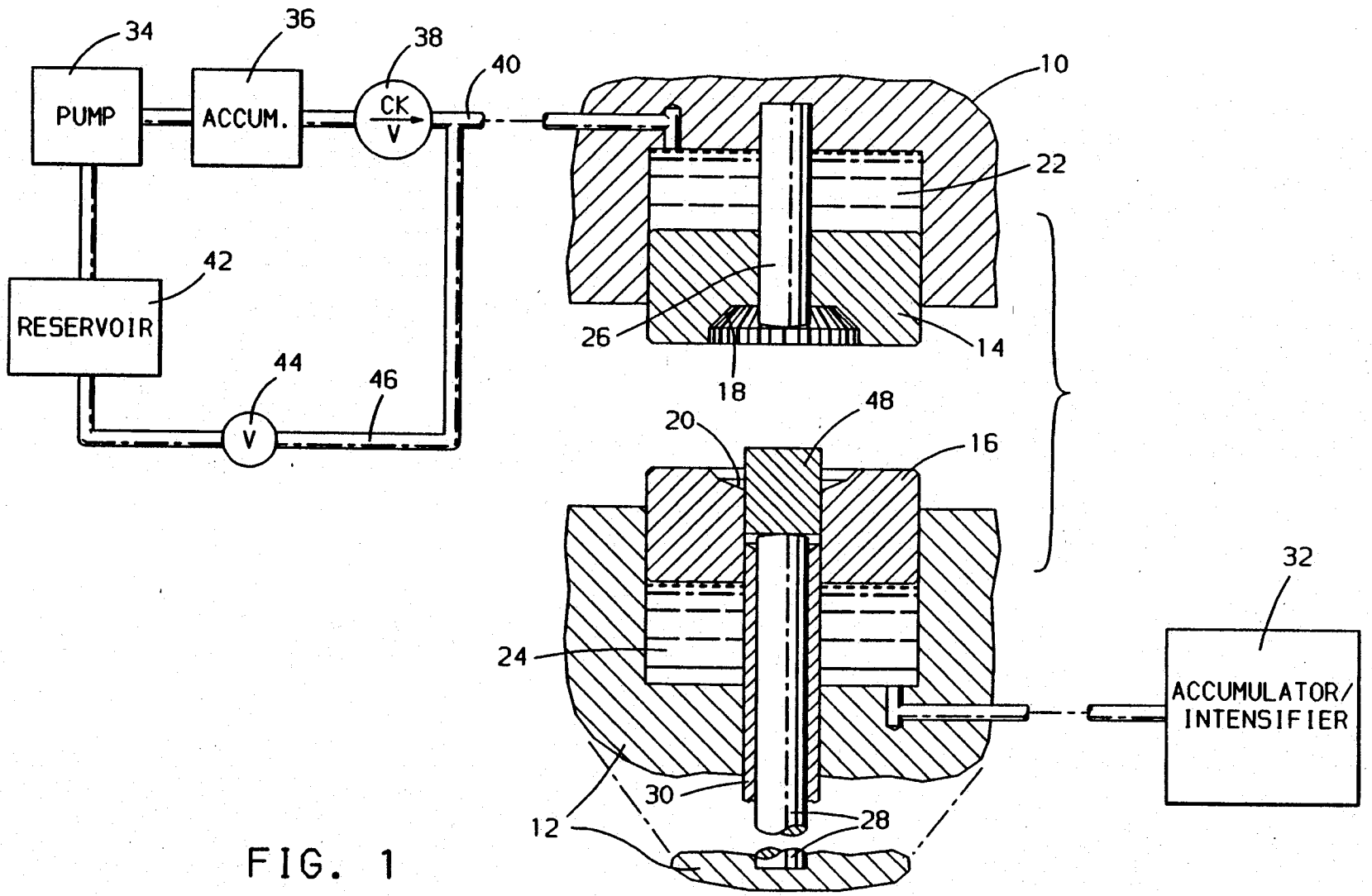
FIG. 1 is a partially schematic view of the apparatus used to practice the invention, showing a portion of the ram and bolster in cross section and showing the punches in elevation.

Referring first to FIG. 1, much of the apparatus used to practice the method of the invention is common to that shown in the patent noted above, but is used in a new way. The common hardware includes a movable upper ram, indicated generally at (10), and a stationary lower bolster, indicated generally at (12). The terminology ram and bolster is arbitrary, and either one, or both, could theoretically move. It is customary for the upper ram (10) to move and for the lower bolster (12) to be stationary, however. Both the ram (10) and bolster (12) are bored out to slidably receive coaxial cylindrical die supports, an upper, ram die support (14) and lower, bolster die support (16). By "die support", it is meant that the members support the matching upper and lower cavities (18) and (20) that together provide all of the part form, but for the aperture. In practice, the die supports (14) and (16) carry separate, removable dies in which the cavities would actually be cut. It is simpler here to depict the die supports and cavities as integral, however. The bore behind each die support (14) and (16) forms a cylindrical, hydraulic fluid filled chamber (22) and (24) respectively, which change in volume as the die supports (14) and (16) slide back and forth in piston like fashion. When the ram (10) and bolster (12) are open, each die support (14) and (16) extends out of its respective chamber (22) and (24) to the greatest degree, and the volume of fluid behind them is therefore largest. Fixed to the ram (10) and bolster (12) are coaxial upper and lower punches (26) and (28), which extend slidably through the die supports (14) and (16) and out of the cavities (18) and (20) respectively. Surrounding the bolster punch (28) is a slidable part knock-out sleeve (30).

Still referring to FIG. 1, separate, dedicated systems are used to control the fluid pressure behind each die support (14) and (16). The bolster chamber (24) is ported to an accumulator/ intensifier system like that described in the patent referred to above, and indicated generally at (32). System (32) has the ability to accumulate hydraulic fluid expelled from bolster chamber (24) and maintain it at a first, higher pressure, and then quickly raise and intensify the pressure to a new, much higher value. In the apparatus described in the patent noted, the two-level pressure capability is used to cushion initial closing impact, and then to prevent die separation throughout the rest of the cycle. Here, that same function is provided and, in addition, system (32) cooperates with a novel pressure control system linked to ram chamber (22) to provide a new function. The separate hydraulic fluid control system linked to ram chamber (22) comprises a high pressure pump (34), an accumulator (36) and one-way check valve (38), to feed fluid into ram chamber (22) through one line (40) from a reservoir (42), and an on-off control valve (44), which lets fluid out of ram chamber (22) to reservoir (42) through another line (46). These separate systems allow the apparatus described to produce an apertured part by the new method described next.

Referring again to FIG. 1, the ram (10) is at its highest point in the cycle, referred to as top dead center. Before the ram (10) is moved, a cylindrical blank (48) of metal is placed into the bolster cavity (20), as shown. The bolster punch (28) is initially oriented lower within its cavity (20), so as to hold the blank (48) easily. At this point, the ram chamber (22) is brought to a predetermined high pressure, somewhere in the range of 2,000 to 2,500 p.s.i., for example. The pressure necessary would be determined based on the pressure calculated to be necessary to extrude blank (48), based on the type of metal involved. Pressurization is accomplished by pump (34) drawing hydraulic fluid from reservoir (42) and pumping it through line (40) into ram chamber (22). Check valve (38) prevents back flow through line (40), and accumulator (36) stores the fluid under pressure so that a sufficient supply of high pressure fluid can be supplied to ram chamber (22) in a short time. The control valve (44) is closed to prevent back flow through line (46). Nonillustrated stop members prevent the ram die support (14) from being expelled. The bolster chamber (24) is at a far lower pressure initially, in the range of only 20 p.s.i., for example.

Figure 3:
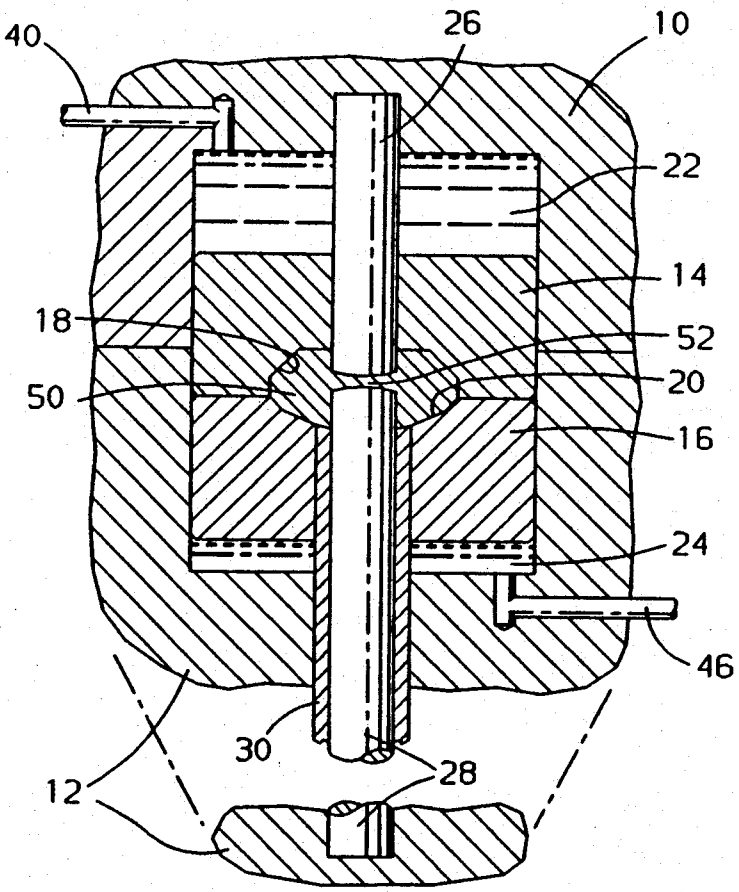
FIG. 3 shows the ram and bolster fully closed, with the metal blank fully extruded.
Figure 2:
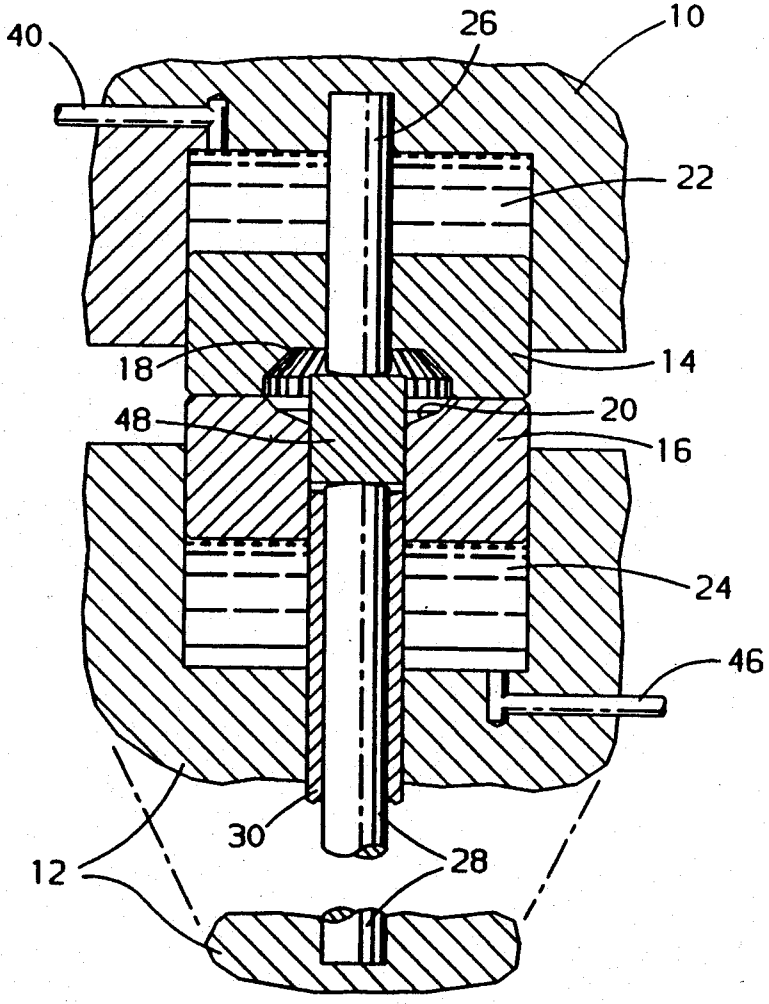
FIG. 2 is part of the apparatus from FIG. 1, showing the die supports at the point of first contact, before the ram and bolster have fully closed.

Referring next to FIGS. 2 and 3, the ram (10) and bolster (12) are next moved partially together, until the die supports (14) and (16) make contact, as shown in FIG. 2. This mates the two cavities (18) and (20). The ends of the coaxial punches (26) and (28) just touch the ends of the cylindrical blank, but no extrusion of metal has yet occurred. The ram (10) is not physically stopped at the FIG. 2 die contact point, but continues to fall in a continuous motion. At and after the FIG. 2 point in the cycle, the pressure in ram chamber (22) is maintained by the check valve (38) and control valve (44). Because it is backed by a much higher pressure, ram die support (14) moves rigidly, one-to-one, with the ram (10), and does not slide over the ram punch (26). It overpowers the bolster die support (16), which is pushed down, sliding over bolster punch (28) and collapsing the bolster chamber (24). Lower pressure hydraulic fluid is forced out of bolster chamber (24), and the force of impact at the die contact point is thereby cushioned. Simultaneously, as ram (10) moves down, the ends of the coaxial punches move together, compressing the blank (48) and forcing it out into the shape of the mated cavities (18) and (20).

Referring next to FIG. 3, the ram (10) has moved all the way down to close with bolster (12), the so called bottom dead center position. The metal blank (48) has become a partially complete part (50). A central, cylindrical aperture has been substantially formed in (50) by the punches (26) and (28), complete but for a thin slug (52) between them. The contact line between the die supports (14) and (16) is below the contact line between the ram (10) and bolster (12), and most of the hydraulic fluid in bolster chamber (24) has been forced out, which is no longer at its initial low pressure. The accumulator-/intensifier system (32), working as described in the patent referred to above, has raised its pressure to a higher intermediate pressure that is closer to, but still less than, ram chamber (22), 1,700 to 1,800 p.s.i., for example. The combined pressures forcing the die supports (14) and (16) together is more than enough to overcome the extrusion force attempting to force them apart, as in a conventional forging operation. However, the differential in pressures that causes the asymmetric motion of the die supports (14) and (16) is used to provide an additional function, described next.

Figure 5:
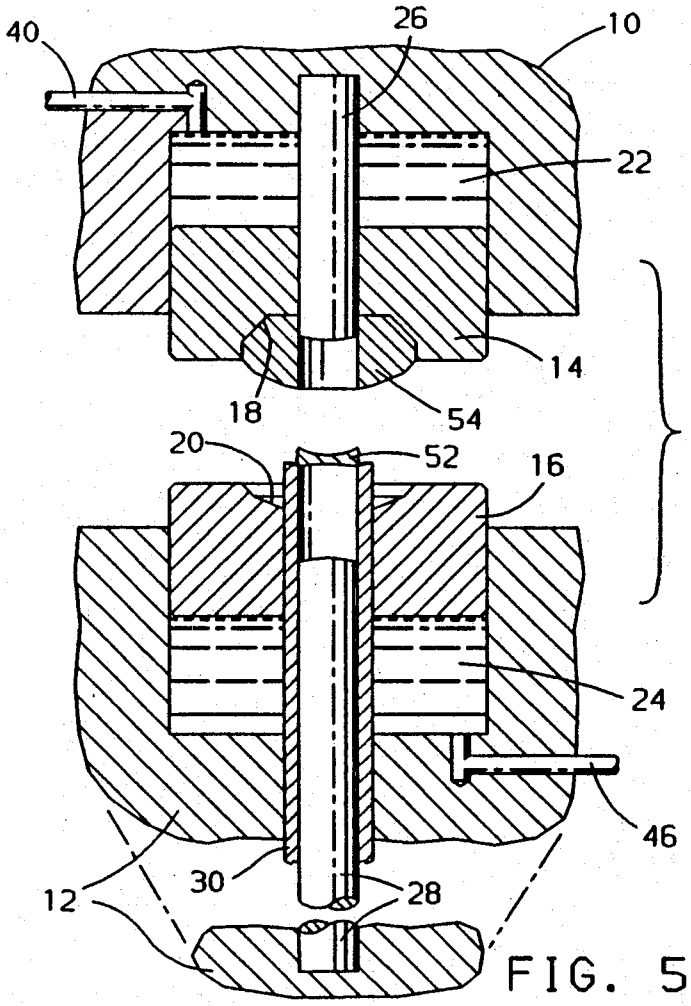
FIG. 5 shows the ram and bolster reopened to allow part removal.
Figure 4:
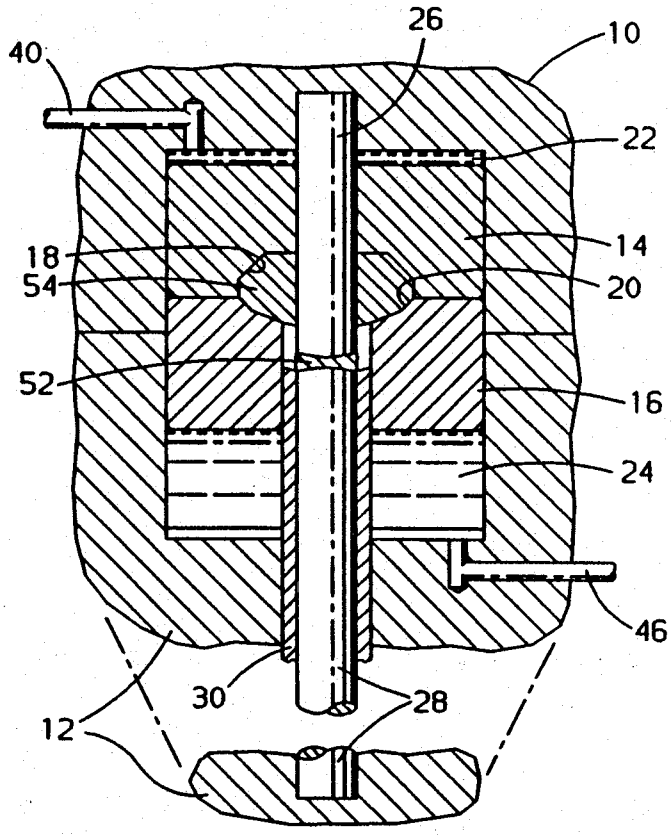
FIG. 4 shows the slug sheared off after the die supports have moved up together over the punches.

Referring next to FIGS. 3 through 5, the final steps in the process are illustrated. At bottom dead center, control valve (44) is opened to allow ram chamber (22) to quickly exhaust through line (46) back to reservoir (42). Simultaneously, the pressurized fluid accumulated in accumulator/intensifier system (32) is allowed to quickly rush back into bolster chamber (24), expanding it. The pressures in the chambers (22) and (24) quickly reach an equilibrium of around 20 p.s.i. As shown in FIG. 4, this quick pressure equalization forces the mated die supports (14) and (16) quickly up, which slide over and are guided by the coaxial, stationary punches (26) and (28). The mated die supports (14) and (16) reverse position, in effect and the contact line between them now moves above the ram (10)-bolster (12) contact line. The result of the quick and forceful reversed relative motion between the die supports (14)

and (16) and fixed punches (26) and (28) is that the slug (52) is sheared off and left behind, creating a complete, apertured part (54). Finally, the ram (10) is moved back to top dead center position, as shown in FIG. 5. The completed part (54) can be pulled out of the ram cavity, and knockout sleeve (30) is raised to push the now sheared off slug (52) up for easy removal.

Thus, one-press cycle is all that is needed to form the completed part (54). The shearing of slug (52) is achieved only at the cost of the additional pressure control system for ram chamber (22). The elimination of the punch and the extra operation to remove slug (52) can represent a substantial savings per part. It should be kept in mind that it is the relative, reversed sliding motion between the fixed punches and the movable die supports, caused by the quickly removed relative pressure differential between the fluid chambers, that gives the shearing action. Therefore, it is arbitrary which die support is upper or lower, which chamber is initially the higher pressure chamber, or whether the ram or bolster is fixed or movable relative to ground. That is, the pressure differential could be switched, with the bolster punch (28) initially high within its cavity (20) and the ram punch (26) initially withdrawn up into its cavity (18). Then, when allowed to equalize, the slidable die supports (14) and (16) would be pushed up, not down, until they were even with the ends of the fixed punches (26) and (28), then they would travel back down, rather than up, to create the shearing action. Theoretically, to create the same shearing action, the punches could be made movable, relative to ram and bolster, and the die supports fixed. But that is impractical, because it is the pressure differential in the chambers, acting on the piston like die supports, that is best used to create the relative shearing motion. The pressure differential in the chambers behind the die supports that creates the relative sliding motion could be created by other means. For example, very high capacity, very fast acting pumps could, on demand, keep one chamber at high pressure and the other at low pressure until bottom dead center was reached, then reverse the pressure differential between the two chambers, as opposed to just allowing the pressure differential to equalize. This would provide the same relative shearing motion, without the various accumulators and valves disclosed. The pressure control systems and schemes disclosed are particularly useful, however, as they make at least partial use of know apparatus. Therefore, it will be understood that it is not intended to limit the invention to just the embodiment disclosed.

The embodiments of the invention in which an exclusive property or privilege is claimed are defined as follows:

1. A method for closed die metal forging a part having an aperture with an apparatus of the type having a movable ram and a fixed bolster that move from an open position to a closed position under force and each of which has a respective coaxial hydraulic fluid chamber formed therewithin, a pair of coaxial punches, each fixed to a respective ram and bolster and extending centrally through a respective chamber, the ends of which move close together without touching when said ram and bolster close to substantially form said part aperture, and a pair of die supports, each one slidably received within a respective chamber and over a respective punch and having cavities configured to form said part when closed together, said method comprising the steps of;

placing a part blank between said die supports while said ram and bolster are in said open position, pressurizing and maintaining said ram chamber with hydraulic fluid to a predetermined high pressure while maintaining said bolster chamber at a low pressure, closing said ram and bolster while maintaining said high and low pressures, thereby pushing said bolster die support into said bolster chamber with said ram die support and moving said punches together to force said blank material out within said cavities, thereby substantially forming said part while leaving a slug between said punch end and simultaneously forcing hydraulic fluid out of said bolster chamber, and, decreasing the pressure in said ram chamber while simultaneously increasing the relative pressure in said bolster chamber and maintaining said ram and bolster in closed position, thereby pushing said ram die support and bolster die support slidably together in the opposite direction within said chambers and over said fixed punches and shearing said slug to complete said part.

2. A method for closed die metal forging a part having an aperture with an apparatus of the type having a movable ram and a fixed bolster that move from an open position to a closed position under force and each of which has a respective coaxial hydraulic fluid chamber formed therewithin, a pair of coaxial punches, each fixed to a respective ram and bolster and extending centrally through a respective chamber, the ends of which move close together without touching when said ram and bolster close to substantially form said part aperture, and a pair of die supports, each one slidably received within a respective chamber and over a respective punch and having cavities configured to form said part when closed together, said method comprising the steps of;

placing a part blank between said die supports while said ram and bolster are in said open position, pressurizing said ram chamber with hydraulic fluid to a predetermined high pressure, filling the bolster chamber with hydraulic fluid to a predetermined low pressure, closing said ram and bolster while maintaining the pressure in said ram chamber so as to push said bolster die support down with said ram die support over said bolster punch and within said bolster chamber, thereby moving said punches together and forcing said blank material out within said cavities, thereby substantially forming said part while leaving a slug between said punch end and simultaneously forcing hydraulic fluid out of said bolster chamber, accumulating and pressure intensifying the hydraulic fluid forced from said bolster chamber to an intermediate higher pressure higher than said bolster chamber low pressure but lower than said ram chamber high pressure, maintaining said ram and bolster in closed position with exhausting said ram chamber of its high pressure and simultaneously allowing said accumulated and pressure intensified hydraulic fluid to re-enter said bolster chamber until said chambers reach a pressure equilibrium, thereby pushing said ram die support and bolster die support slidably up together within said coaxial chambers and over said fixed punches and shearing said slug to complete said part.

* * * * *